United States Patent [19]

Giordano

[11] 3,961,390

[45] June 8, 1976

[54] PROCESSES AND DEVICES FOR BUFFING THE SOLES OF SHOE UPPERS

[75] Inventor: Antonio Giordano, Florence, Italy

[73] Assignee: Viges S.p.A., Vigevano (Pavia), Italy

[22] Filed: July 30, 1974

[21] Appl. No.: 493,190

[30] Foreign Application Priority Data

Sept. 24, 1973 Italy ..... 42719/73

[52] U.S. Cl. ..... 12/1 A; 12/79.5

[51] Int. Cl.[2] ..... A43D 95/00

[58] Field of Search ..... 12/1 A, 79.5, 17 R, 12/17.2, 36, 36.8, 37, 18.5; 69/6.5

[56] References Cited

UNITED STATES PATENTS

| | | | |
|---|---|---|---|
| 3,025,542 | 3/1962 | Piotrowski et al. | 12/79.5 |
| 3,400,561 | 9/1968 | Bechtold | 12/17 R |
| 3,603,120 | 9/1971 | Schilke | 12/17 R |

*Primary Examiner*—Patrick D. Lawson

*Attorney, Agent, or Firm*—Pollock, Vande Sande & Priddy

[57] ABSTRACT

A process for carrying out the buffing of the upper sole of shoes wherein said buffing is effected by a sequence of passages of a buffing tool, wherein each buffing passage effects the machining of an elemental area of the sole of the upper, said sequence of passages being so arranged that a peripheral overlapping of the single buffed elemental areas will be obtained, so as to obtain a uniform buffing of the entire sole of an upper of a shoe.

3 Claims, 10 Drawing Figures

FIG.1A
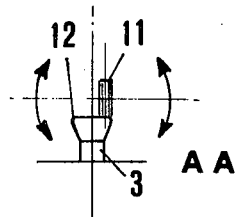
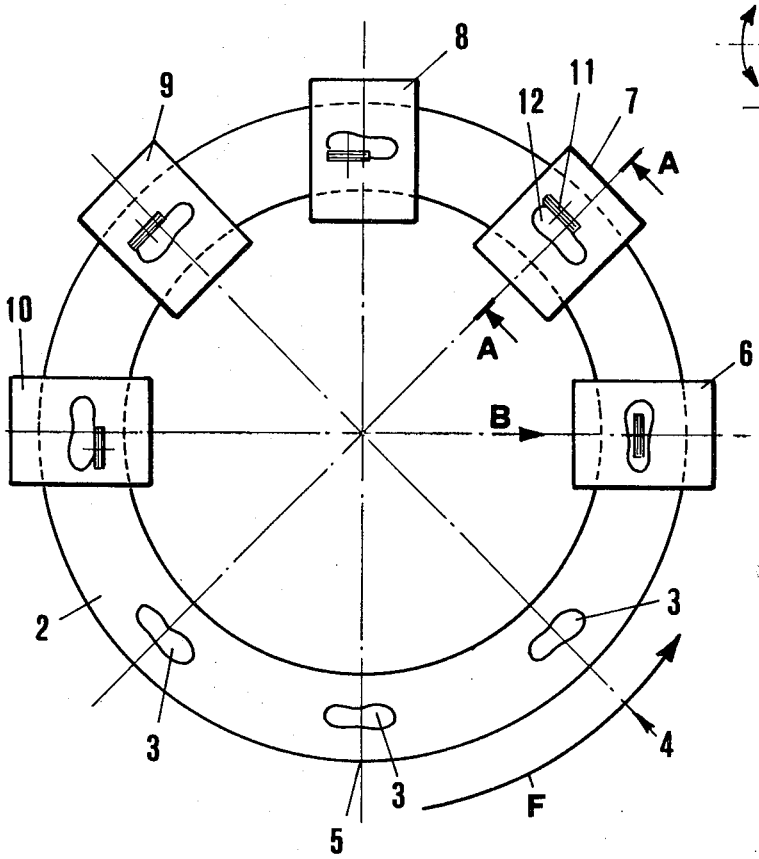
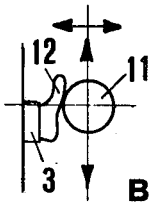
FIG.1B
FIG.1

PROCESSES AND DEVICES FOR BUFFING THE SOLES OF SHOE UPPERS

The present invention relates to an improvement in the processes and apparatus for buffing the soles of shoe uppers already mounted on the shoe last, and already assembled with the innersole, by zones in a plurality of sequential partial stages.

The purpose of the present invention is to provide means allowing the buffing of the uppers to be carried out automatically, this operation being necessary in the manufacture of shoes of whatever kind in order to enable the soles to be mounted, assuming of course that the shoes consist of an upper, of an inner sole and of a sole.

In order to better understand the nature of the present invention, it should be borne in mind that a shoe does not have a simple geometrical shape, such as a portion of a circle or of a plane, but rather has portions of various kinds of surfaces. Consequently, machining of the surface of the plan of a shoe, and, in the case of the present invention, buffing, is not possible in a single operation as it might be in the case of a planar or spherical surface. Machining of a surface like that of the innersole of a shoe can be performed only by sequential approximations which "blend" with one another until the required machining throughout the extension of the surface in question is completed.

According to the present invention, this problem is solved by machining of the uppers sole of the shoe by repeated passages, each of which affects an elemental area of the shoe, until the entire surface of the part of the upper sole of the shoe to be buffed is affected in a continuous manner.

The invention will be now described with reference to certain preferred embodiments thereof disclosed by way of example and with reference to the attached drawings, wherein:

FIG. 1 schematically shows a first embodiment of a machine for buffing the soles of shoe uppers, according to the present invention, wherein the operations are sequentially carried out during the continuous displacement of the machined shoes along a closed circular path;

FIG. 1A shows a section of FIG. 1 at line A—A;

FIG. 1B shows a section of FIG. 1 at B;

Figure 2:
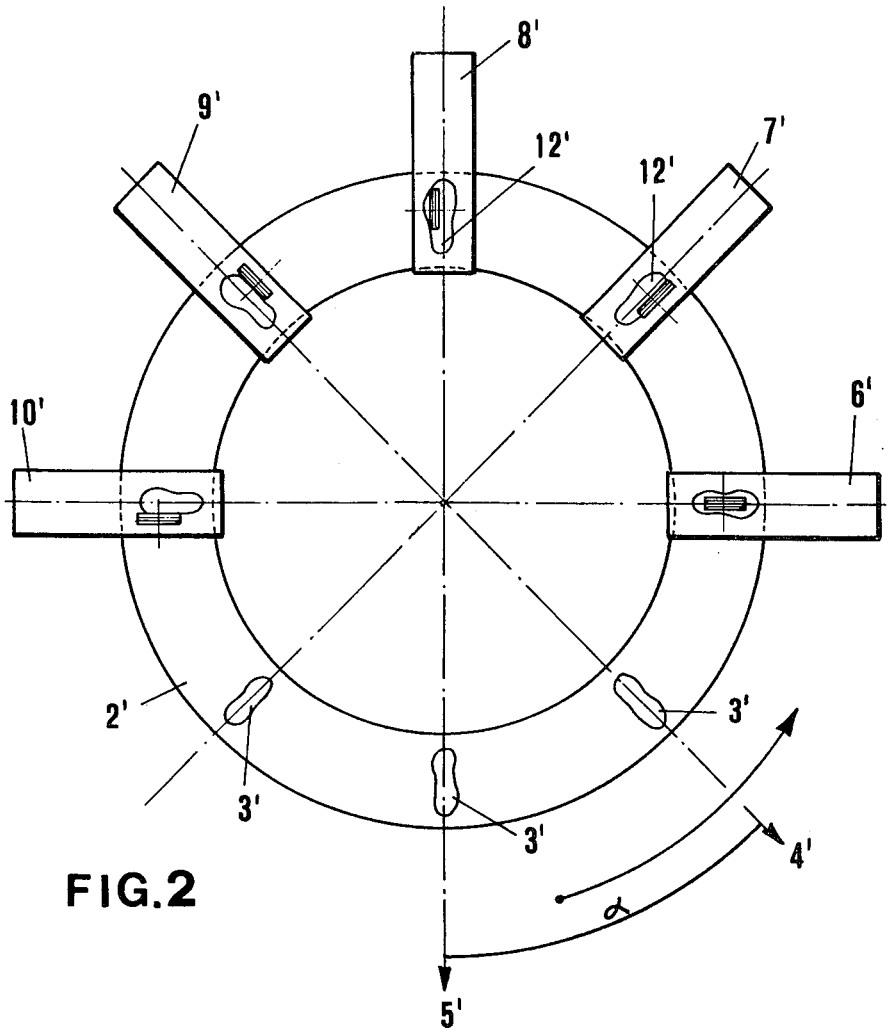
Figure 2A:
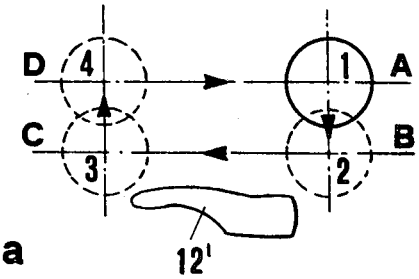
Figure 3:
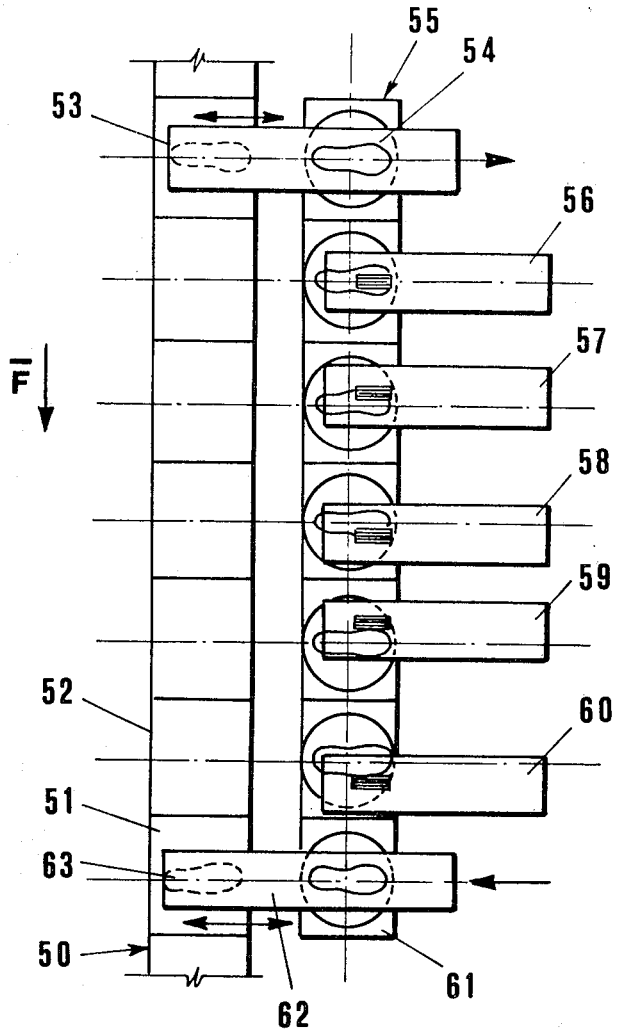
Figure 4:
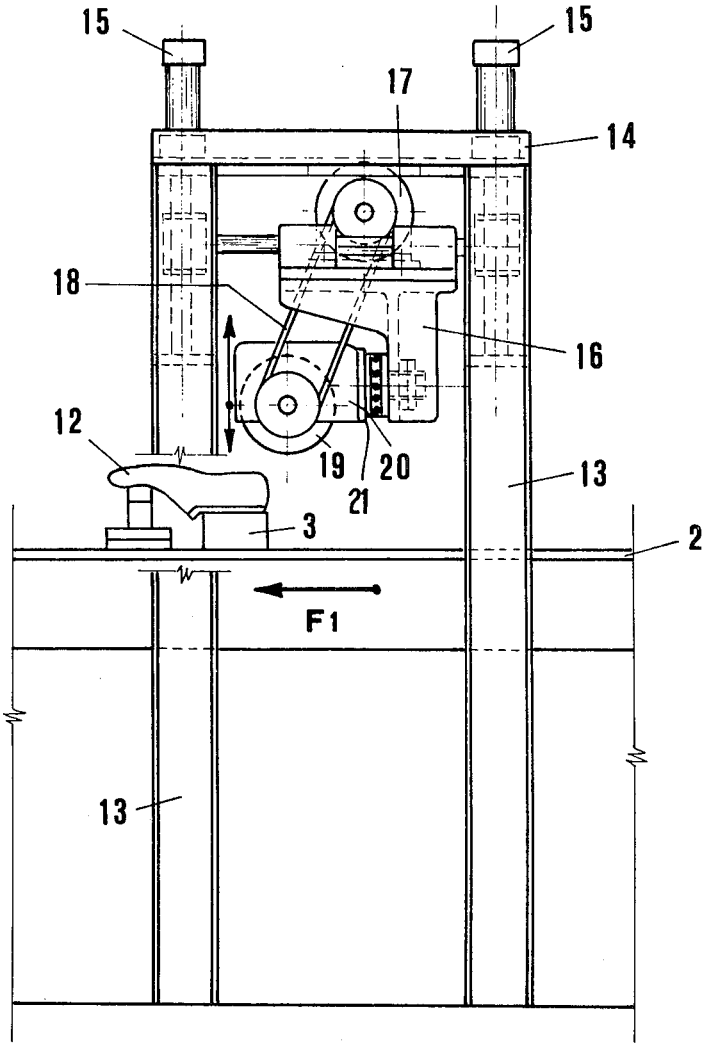
Figure 5:
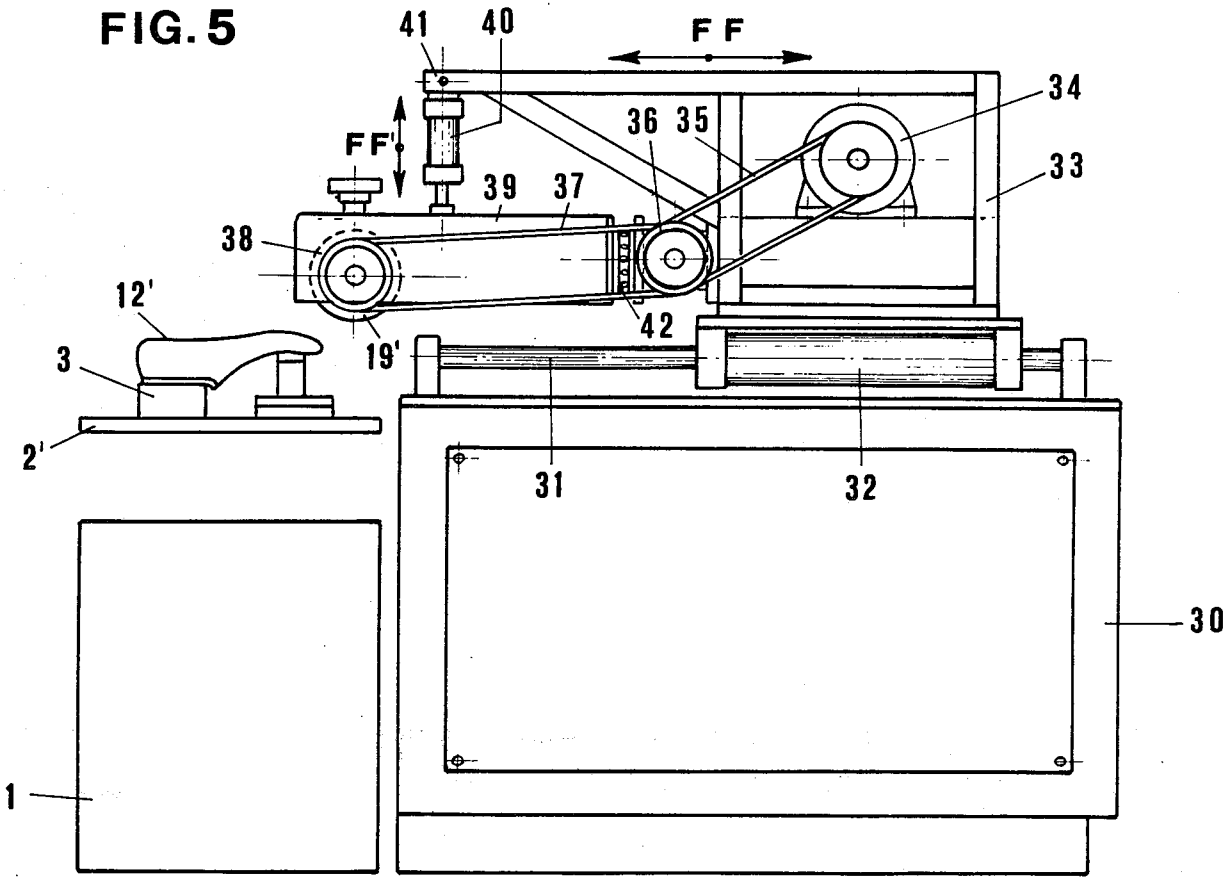
Figure 6A:
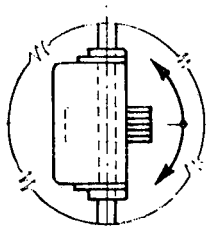
Figure 6:
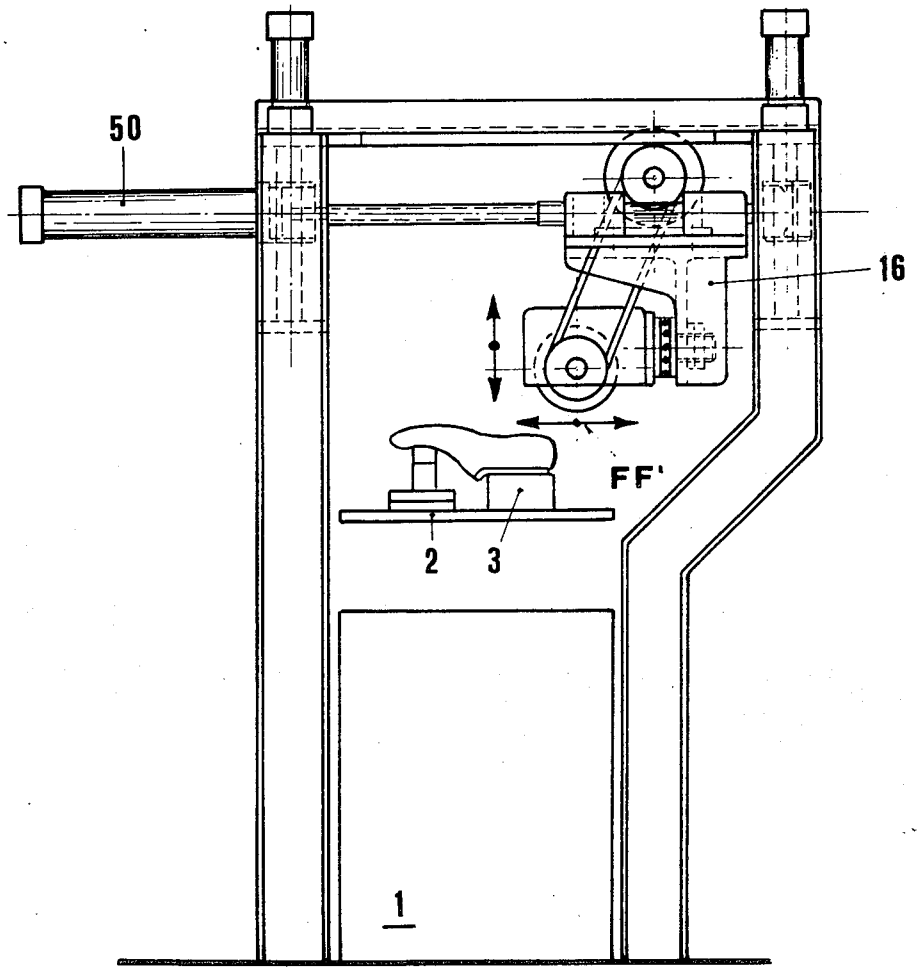

FIG. 2 schematically shows a second embodiment of a machine for buffing the soles of uppers, according to the present invention, wherein the operations are carried out sequentially during a stepwise displacement of the machined shoes along a closed circular path;

FIG. 2A shows schematically the path traversed by a buffing tool in accordance with the embodiment of FIG. 2;

FIG. 3 diagrammatically shows a third embodiment of a machine for buffing the soles of shoe uppers according to the present invention, wherein the operations are sequentially carried out during the diplacement of the shoes along a rectilinear path of transfer;

FIG. 4 shows an embodiment of the buffing devices of the elemental areas of the upper which can be used in the machine as schematically shown in FIG. 1;

FIG. 5 shows an embodiment of the buffing devices for elemental areas associated the upper which can be used in the machine as schematically shown in FIG. 2;

FIG. 6 shows a variant of the embodiment of the buffing device according to FIG. 5.

FIG. 6A shows the work tool of the embodiment of FIG. 6.

In describing the apparatus according to the present invention, it will be assumed that the uppers of the shoes to be submitted to buffing are mounted on a suitable "last", allowing the accurate positioning in register with the various machining parts of the machine itself. The various embodiments which will be described provide for machining during either continuous movement or stepwise movement of the part to be machined. The apparatus for carrying out the buffing operation will of course differ according to the nature of the movement.

With reference now to FIG. 1, a machine is shown therein comprising a base on which is rotatably mounted an annular support 2 comprising a plurality of seats 3 for the shoe lasts on which each upper is mounted. Assuming that support 2 will rotate continuously in the direction as shown by the arrow F, it can be assumed that the insertion of the last in seat 3 will occur at 4, and that at 5 the last, with the upper the buffing of which has been completed, will be removed.

The piece to be machined, located in seat 3, encounters during its travel defined by the revolution of annular support 2, a multiplicity of work stations (buffing of elemental areas of the upper sole) schematically shown in FIG. 1 and denoted by reference numerals 6, 7, 8, 9, 10. At each of these stations a predetermined area of the upper sole carried by seat 3 will be submitted to a buffing operation. It is evident that the number of work stations can be increased as desired, depending upon either the required degree of finish or the geometrical complexity of the upper sole to be submitted to buffing.

Also schematically, FIGS. 1, 1A and 1B show the relation between the steel wire buffing wheel, or the like, as known in the art, and the sole of the upper, according to the present invention. In fact, as shown in the schematic representations of stations 6 . . . 10, the wheels 11 and the upper 12 will be located in different positions, with respect to one another until, by sequential steps, the whole surface of the sole is buffed.

With reference to FIG. 4, an embodiment of one of the buffing stations will now be described.

The buffing station comprises a bridge support 13 located over the annular movable support 2. On the cross member 14 of the bridge support 13 the bidirectional resilient devices 15 are mounted for up-and-down movement, thus allowing vertical reciprocation of the head 16 of the buffing unit to follow the vertical profile of the surface of the upper sole.

Other devices, not shown in the figure, allow the head 16 to be positioned cross-wise with respect to the surface of the upper sole at the various machining stations.

Mounted on the head 16 is a motor 17 which, by means of a belt 18, rotatably drives a tool 19 consisting, for instance, of a steel wire brush, and carried by a tool carrier 20. A knuckle device 21 allows the tool carrier 20 to be oriented under a certain angle for adjusting the position of mutual engagement between the tool 19 and the upper 12. If desired, motor 17 can be mounted directly on the tool carrier 20 in order to drive tool 19 directly on its spindle.

When the annular support 2 during its rotation (as shown by arrow F1) of FIG. 4 carries the upper 12 under the tool 19, this tool will buff a certain zone as predetermined during the tooling stage of the particular work station.

As aforesaid, by means of the various cross-wise adjustments of head 10 and of tool carrier 20, the desired buffing of the sole of the upper can be obtained by sequential elemental areas after pasage through all of the work stations.

FIG. 2 schematically shows a second embodiment of a machine for buffing the sole of an upper, namely, a machine operated stepwise, instead of continuously.

Also in this embodiment an annular support 2' is provided, movable by steps through an angle $\alpha$ between one buffing operation and the next one on a zone of the upper sole.

In the embodiment shown in FIG. 2, the seats 3' of the lasts on which the uppers to be buffed are mounted are rotated through 90° relative to the position of the seats shown in FIG. 1. As in the embodiment of FIG. 1, work stations, denoted by reference numerals 6', 7', 8', 9', 10', are associated with the annular support 2'. Also in this embodiment there is a station for the insertion of the lasts carrying the uppers, e.g., at 4', and a station for the removal of the machined piece, e.g., at 5'.

While in the embodiment shown in FIG. 1 the buffing through zones was carried out along a circumferential path concentric with annular support 2, in the embodiment shown in FIG. 2 the buffing through zones is carried out by means of a sequence of radial passages by "longitudinal" buffing stations each having a tool (a wire brush) which moves through an approximately rectangular path (FIG. 2A). More particularly an upper 12' mounted on its last is submitted to buffing during the portion B → C of the rectangular path A → B → C → D → A followed by the buffing tools operating at the various work stations.

FIG. 5 shows a first embodiment of one of the buffing stations aassociated with the machine shown in FIG. 2. This buffing station includes a base 30 located near the annular support 2' carrying the uppers 12' mounted on their supporting lasts. An arranement of either pneumatic or hydraulic cylinders 31, 32 supports a frame 33 for to-and-fro longitudinal movement, as shown by the arrows FF. Mounted on the frame 33 is a motor 34 which through a drive including the belts and pulleys 35, 36, 37, 38 operates a tool 19' which carries out the buffing operation of one zone of the upper 12'.

The tool 19 is supported by a tool carrier 39 in turn resiliently supported by resilient means 40 located between said tool carrier and a bracket 41 associated to the frame 33. The resilient means 40 permits the vertical reciprocation of tool 19' as shown by the arrows FF', so that during the stroke FF the tool 19' will be able to buff a zone of the surface of the upper sole as predetermined at the time the work station was tooled.

As previously mentioned with reference to FIG. 4, the tool carrier 39 can be adjusted as to its orientation, by means of the articulation 42.

FIG. 6 shows a second embodiment of one of the buffing stations associated with the machine shown in FIG. 2. As can be seen in FIG. 6, the embodiment is substantially identical with that of the buffing station shown in FIG. 4, with the difference that pneumatic or hydraulic means have been added to allow reciprocation of head 16, as shown by the arrows FF'. Of course the buffing station as shown in FIG. 5 has an upper clearance sufficient to permit the longitudinal displacement of head 16 for carrying out the buffing operation in the desired zone.

FIG. 3 shows a further embodiment of the buffing machine according to this invention, in which, the machining operations are carried out "in line". The detail shown in FIG. 3 can be considered to be part of a "transfer" line, in which can be carried out all operations relative to the manufacture of shoes.

As can be seen in FIG. 3, a main transfer line 50 is provided, subdivided into a multiplicity of stations 51, 52 . . . each of said stations being associated with a last and its upper. Assuming the direction of the movement of line 50 to be that shown by the arrow $\overline{F}$, by the shoe moving station 53, one last with an upper will be moved to the position 54 of the secondary transfer line. At each step of dwell of the main line 50 and of the secondary line 55, the lasts with the uppers thereon are moved to the secondary line where, at stations 56, 57, 58, 59, 60, the upper sole will be submitted to buffing by zones of the nature illustrated and described with reference to FIGS. 5 or 6. The sequence of operations is obvious and will not be described in detail.

At the end of the operations, the shoe moving station 62 returns the last with the upper the sole of which has been buffed from stations 61 to station 63 on the main transfer line 50.

Having thus described the present invention, what is claimed is:

1. An apparatus for buffing the soles of shoe uppers, comprising a continuously movable annular element for supporting lasts on which are fixed the shoe uppers to be buffed, a multiplicity of buffing machines bridging said annular element, each such buffing machine being arranged for buffing a single individual area of the shoe uppers, the longitudinal axes of the lasts on which the uppers are mounted being located concentrically with the annular support element, the number and location of the buffing machines being such that, after the passage of each upper under the said multiplicity of buffing machines, the sole of such upper will be entirely buffed.

2. An apparatus as claimed in claim 1, wherein the annular support element is movable stepwise, and the said multiplicity of buffing machines for the elemental areas are located near the annular support element with their operating axes located along radii passing substantially through the center of the annular support element, the buffing machines being displaceable along the sole of the upper during the dwells of the annular supporting element, the arrangement being such that the longitudinal axes of the lasts on which the uppers are mounted will be located along radii passing substantially through the center of the annular support element.

3. An apparatus as claimed in claim 1, wherein the movable support element includes elements of a secondary transfer chain, a main transfer chain operatively associated with the said secondary transfer chain, means for moving the lasts from the main transfer chain to the secondary transfer chain, and a multiplicity of zone buffing machines located along the secondary transfer chain.

* * * * *